US006286754B1

(12) United States Patent
Stier et al.

(10) Patent No.: US 6,286,754 B1
(45) Date of Patent: Sep. 11, 2001

(54) PAPERBOARD CUP HOLDER

(75) Inventors: David E. Stier, Loveland; Kurt D. Jensen, Lebanon; Stephen M. Blackman, Maineville, all of OH (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 09/805,146

(22) Filed: Mar. 14, 2001

(51) Int. Cl.[7] ..... B65D 3/22

(52) U.S. Cl. ..... 229/403; 229/4.5; 220/738; 220/739

(58) Field of Search ..... 229/4.5, 403; 220/737, 220/738, 739, 903

(56) References Cited

U.S. PATENT DOCUMENTS

| | | | | |
|---|---|---|---|---|
| 2,661,889 | * | 12/1953 | Phinney | 220/903 |
| 3,203,611 | * | 8/1965 | Anderson et al. | 229/403 |
| 5,205,473 | | 4/1993 | Coffin . | |
| 5,209,367 | | 5/1993 | Van Musscher et al. . | |
| 5,259,529 | | 11/1993 | Coale . | |
| 5,425,497 | | 6/1995 | Sorensen . | |
| 5,454,484 | | 10/1995 | Chelossi . | |
| 5,547,124 | * | 8/1996 | Mueller | 229/403 |
| 5,669,553 | * | 9/1997 | Smith | 220/738 |
| 5,746,372 | | 5/1998 | Spence . | |
| 5,769,311 | * | 6/1998 | Morita et al. | 229/403 |
| 5,794,843 | | 8/1998 | Sanches . | |
| 5,826,786 | | 10/1998 | Dickert . | |
| 5,842,633 | | 12/1998 | Nurse . | |
| 5,857,615 | | 1/1999 | Rose . | |
| 6,068,182 | | 5/2000 | Tockunaga . | |
| 6,186,394 | * | 2/2001 | Dees et al. | 229/403 |

* cited by examiner

*Primary Examiner*—Gary E. Elkins

(57) ABSTRACT

A paperboard cup holder for use with a hot coffee cup, the cup being tapered as in the form of a cross section of a right circular cone of relatively small taper angle. Such cups are generally of paperboard or plastic and are often used in vending machines and fast food retail outlets for serving hot coffee. The holder is formed from a flat, generally arcuate unitary paperboard blank having a convex outer edge and a concave inner edge. The arcuate length of the blank is substantially the same as the mid circumference of the cup, and the ends of the blank are glued together to form an annular holder. The upper edge of the blank integrally carries a plurality of apertured flaps which bend 180 degrees to as to lie parallel with the main portion of the blank. When the holder is slid onto a cup, the apertured flaps are sandwiched between the outer (hot) surface of the cup and the main portion of the holder. The flap apertures define small, closed air chambers which assist, with the paperboard of the holder, in inhibiting heat flow to the fingers of the person holding the cup. Spaces between the flaps define air filled channels which further assist in inhibiting heat flow from the hot coffee to the finger tips of the user.

12 Claims, 3 Drawing Sheets

PAPERBOARD CUP HOLDER

BACKGROUND OF THE INVENTION

This invention relates to containers and more particularly to a holder for a paperboard cup, such as those commonly employed in vending machines and in fast food outlets for dispensing hot coffee. Cup holders may be fashioned of corrugated paperboard, molded plastic materials, or specially configured paperboard. In the fast food industry, one requirement of such holders is that they be inexpensive to fabricate, easy to store and use, while also yielding appreciable thermal insulation so that the consumers do not feel uncomfortable when holding a cup of hot coffee.

BRIEF DESCRIPTION OF THE INVENTION

According to the practice of this invention, a paperboard holder for hot coffee is fashioned from a unitary blank of paperboard. The blank consists of a strip, also termed a main strip, which is arcuate. The arcuate strip has a lower edge and an upper edge, with the upper edge having a plurality of flaps integrally foldably connected to the main strip. The lower edge of the strip is concave and the upper edge is convex. The flaps are spaced apart from each other along the main arcuate strip and are each provided with a plurality of openings which extend completely through the paperboard. The flaps are folded substantially 180 degrees back onto one of the two strip surfaces, the ends of the main strip are overlapped and glued together, and the resultant annular or ring shaped structure is placed on a coffee cup by sliding it upwardly, beginning at the bottom or smallest diameter portion of the coffee cup, with the flaps positioned between the main strip and the cup outer surface. The user holds the cup of hot coffee by placing the thumb and fingertips on the holder, with the thermal insulating properties of the paperboard flaps acting to inhibit heat transfer to the fingertips from the hot coffee in the cup, and also utilizing the insulating properties of the air trapped within the openings in each of the flaps. Each flap is sandwiched between the exterior surface of the coffee cup and the main arcuate strip. Thus, the known low thermal conductivity properties of both air and paperboard are utilized in this invention.

DETAILED DESCRIPTION OF THE INVENTION

Figure 1:
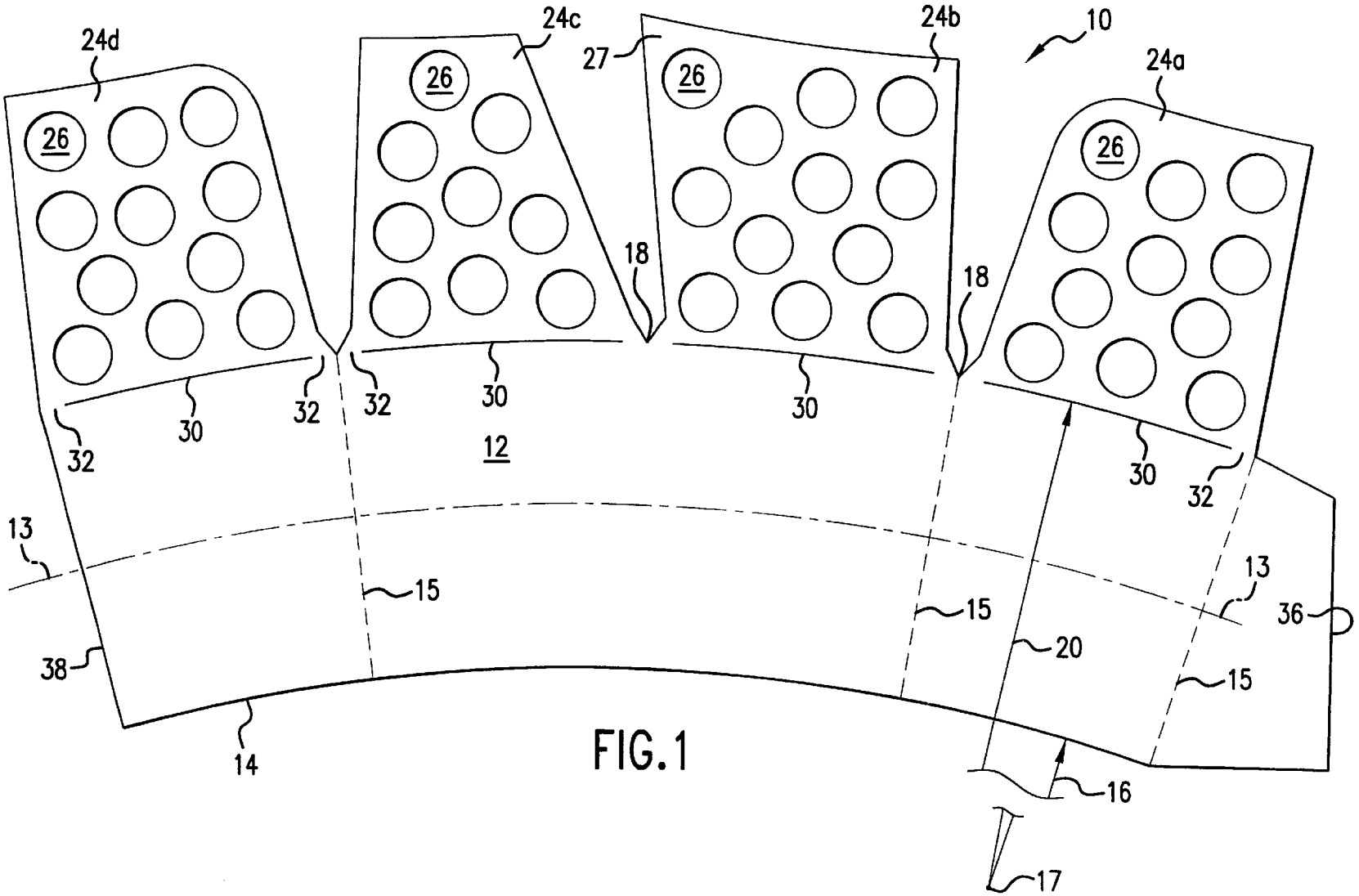
FIG. 1 is a plan view of a unitary blank of paperboard or other stiff, resilient, and bendable sheet material of low heat conductivity used to form the present invention.

Referring now to FIG. 1 of the drawings, a unitary and elongated flat paperboard blank 10 is illustrated, the blank including a main, slightly curved or arcuate strip 12, the latter having a lower concave edge 14 and an upper convex edge 18 as viewed in FIG. 1. Curved upper edge 18 may be considered as having a radius 20, while curved lower edge 14 may be considered as having a smaller radius 16, both radii 16 and 20 referred to a center of curvature such as 17.

Each of a plurality of flaps, integral with strip 12, is designated as 24, each flap 24 having a plurality of cut holes or openings 26 distributed over the surface of the flap. The flaps bear subscripts a,b,c,d to distinguish them from each other. The base of each flap 24, where the latter is connected to main strip 12, contains a foldable connection, here in the form of an arcuate cut line 30 and portions 32, with each cut line 30 extending completely through the paperboard. Cut lines 30 are located adjacent the bases or lowermost central portions of the respective flaps, while the end portions of cut lines 30 terminate at integral paperboard portions 32 which serve as integral links and foldably join each flap to the main arcuate strip 12. Arcuate cut lines 30 are of the same curvature as that of convex edge 18, and are collinear therewith. Thus each flap has two integral portions 32 and one cut line between the latter. As shown in FIG. 1, one free corner of the outer edge of flap 24*b* protrudes leftwards and radially outwardly, for a purpose soon to be given. Flap 24 extend outwardly from strip 12 in a generally radial direction, as referred to radii 16 and 20 and center of curvature 17.

In theory, hinges defined by cut lines 30 and portions 32 could be replaced by scores or by perforations. However, such replacement would result in wrinkling and not result in flaps 24, after folding or bending them, smoothly matching the curvature of cup 50, as will be explained later with respect to FIGS. 2 and 3. The best mode of the invention is thus that using cut lines 30 and integral portions 32.

The right and left longitudinal ends of main arcuate strip 12 are designated respectively as 36 and 38, and are intended to be overlapped and glued together. A curved reference axis 13, which may be regarded as a longitudinal axis, having the same center of curvature 17 as edges 16 and 18, runs through the mid section of main arcuate strip 12.

It is seen that two spaced radially extending fold lines 15 extend across the width of the main strip 12, and are located between the bases of flaps 24*c* and 24*d*, as well as between the bases of flaps 24*a* and 24*b*. These fold lines facilitate the folding, to a generally flattened form, of the annulus formed when the main strip ends 36 and 38 are glued together.

Figure 2:
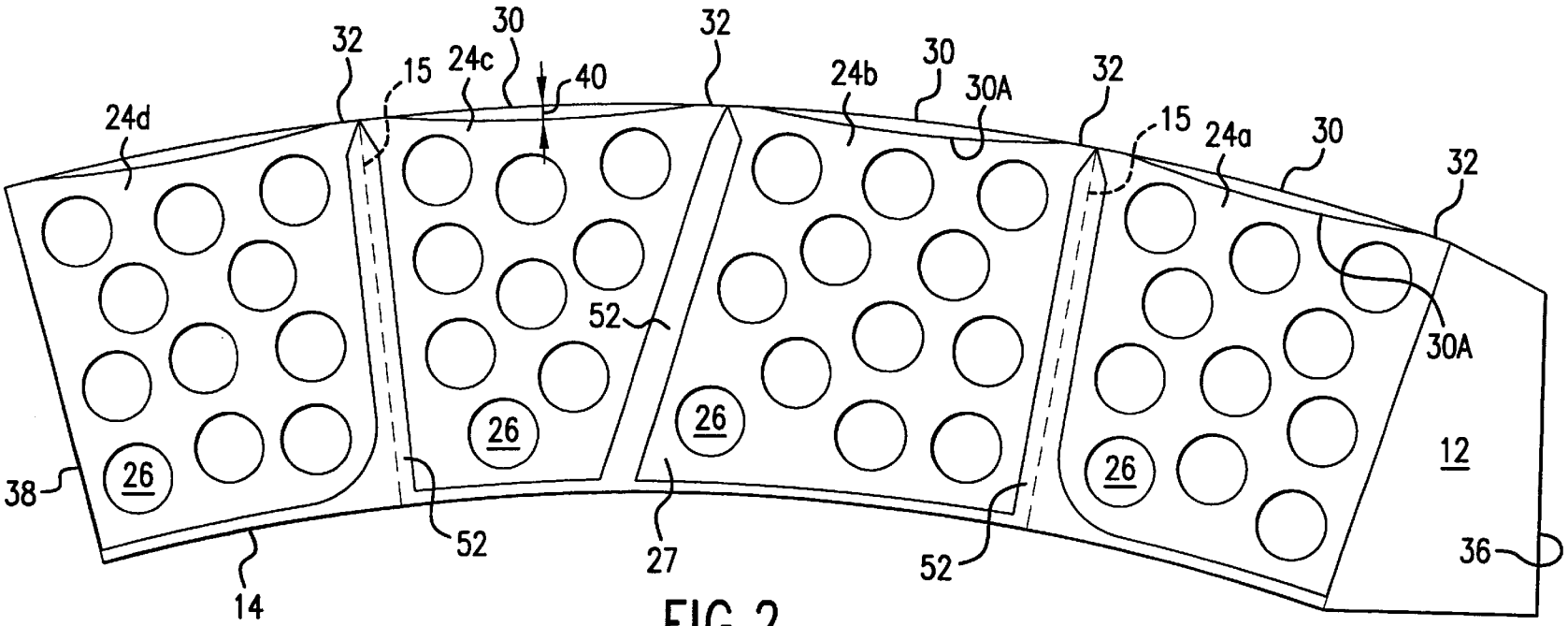
FIG. 2 is a view similar to FIG. 1 and shows the cup holder after its flaps have been bent down so as to lie against, or be in substantial parallelism with, the main arcuate strip of the holder on an inside surface of the main strip.
Figure 3:
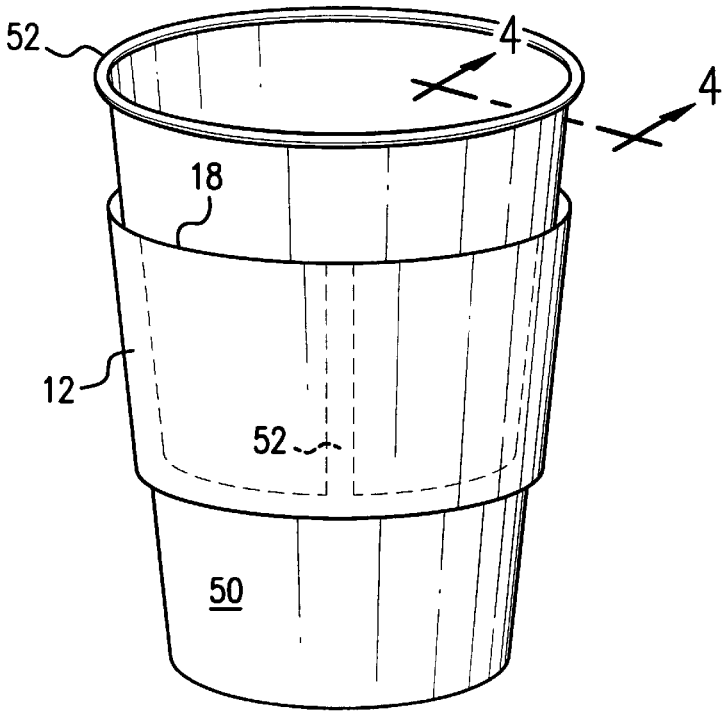
FIG. 3 is a perspective view showing the cup holder of this invention as surrounding a cup.

Referring now to FIG. 2, the individual flaps 24 have been bent or folded approximately 180 degrees about their respective bases, the direction of bending being either toward or away from the reader (shown in FIG. 2 as toward the reader). It is necessary to bend them so that they are in substantial parallelism with main arcuate strip 12. Ends 36 and 38 of main strip 12 are overlapped and glued so as to form a continuous arcuate member of sufficient circumference to extend completely around a typical tapered paperboard coffee cup. The holder is thus annular or ring shaped. This is illustrated at FIG. 3 wherein the holder is shown as surrounding the outside surface of a typical tapered paperboard coffee cup 50, the latter often provided with a bead 53 around its upper circumference. Some of the flaps 24 are illustrated in phantom lines at FIG. 3.

Figure 4:
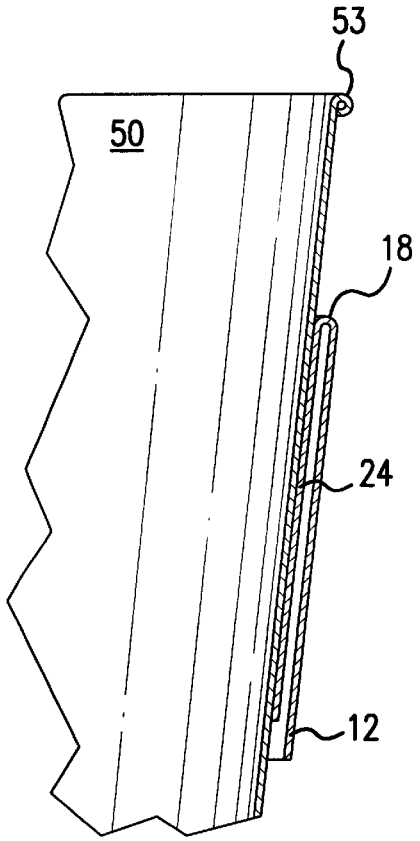
FIG. 4 is a view taken along Section 4—4 of FIG. 3 and illustrates the relation between the wall of a coffee cup and the cup holder of this invention.

Referring now to FIG. 4, the section taken along 4—4 of FIG. 3 shows that each flap 24 is sandwiched between the outer surface of cup 50 and one surface of the main arcuate portion 12 of the holder. The user or consumer grasps the cup holder by squeezing the thumb and one or more fingertips against the surface of the holder.

From the above description, it is seen that openings 26 in flaps 24 each define (with the cup) a substantially closed volume, with on e end of each such volume or small air chamber bounded by the external surface of cup 50, and with the other end bounded by main arcuate strip 12. The side surface or periphery of each chamber is defined by the interior surface (the thickness of the paperboard) of each opening 26. These small volumes or small chambers are an important feature of the present invention in that they utilize the well known poor thermal conductivity of air to inhibit transfer of heat from the hot outer surface of the cup to the finger tips of the consumer. Typically, the thermal conductivity of air is approximately 0.015 BTU/hr ft F, while the thermal conductivity of paperboard is approximately 0.031 BTU/hr ft F. The thermal conductivity of air is thus about one-half of that of paperboard. Hence flap holes or openings 26, which form the small air chambers during operation of the cup holder, improve the insulating property of the latter. The holes or voids 26 may be non-circular, with their size and pattern maximizing (for a given paperboard thickness and composition) the number of holes while leaving enough paperboard to keep the flaps intact during manufacturing and erection (folding and glueing) of the blanks.

FIG. 2 illustrates cut line portions 30A of each flap. Portions 30A arise after each flap is folded. In FIG. 2, the gap between cuts 30 on main arcuate strip 12 and portions 30A of the flaps is denoted as 40. If cuts 30 were not arcuate, the bending or folding of flaps 24 down could result in flap wrinkling upon folding. Wrinkling would inhibit the required smooth curving of each flap onto the curved outer surface of the coffee and interfere with the formation of the small, closed air volumes or chambers formed from openings 26 when the flaps are sandwiched by the cup surface and main strip 12. This, in turn, would diminish the heat insulation property of the holder. The same action takes place with the modification of FIG. 5.

As indicated in FIG. 2, and also indicated at FIG. 3, a space or channel 52 extends between adjacent flaps 24. After the holder is placed around a cup, each channel is bordered by side edges of adjacent flaps 24, by main strip 12, and by the outer surface of the cup. Each channel is substantially open at its top and bottom. These air filled channels 52 constitute voids for insulation that allow air to circulate through them. Further, fold lines 15 are located between flaps 24*c* and 24*d*, and between flaps 24*a* and 24*b*, to allow for better folding and glueing during manufacturing. The middle channel 52 between flaps 24*b* and 24*c* is slanted, i.e., does not extend radially (see FIG. 2) as do the other two channels. Enlarged portion 27 of flap 24*b* extends towards adjacent flap 24*c*, with the right edge of the latter cut back somewhat, as seen in both FIGS. 1 and 2. When the FIG. 2 construction is folded and glued to form an annulus, portion 27 of flap 24*b* will inhibit folding or crinkling of the outer surface of the cup holder defined by those panels of main strip 12 which include the middle two flaps 24*b* and 24*c*.

Figure 5:
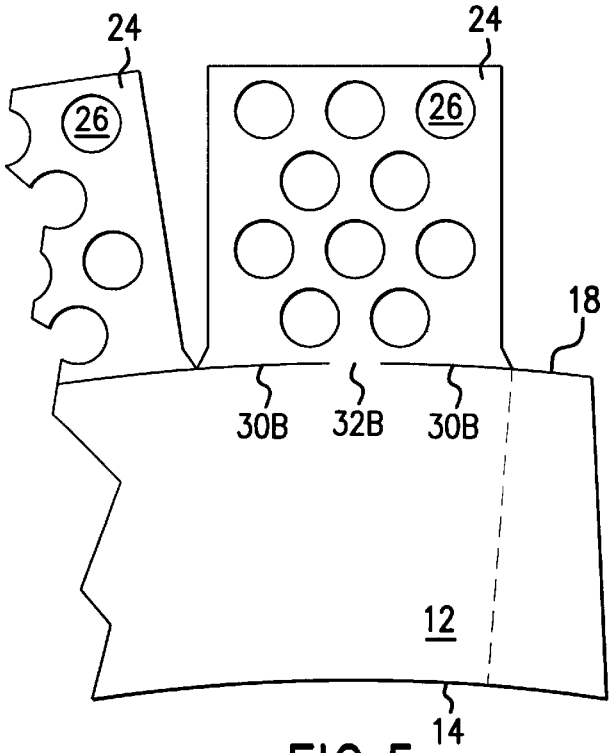
FIG. 5 is a partial plan view illustrating a second embodiment of the paperboard cup holder of this invention.

Referring now to FIG. 5, a modification is shown wherein each flap 24 is secured by a single integral portion 32B to main strip 12. The curved cut line 30 at the hinge of each flap 24 is no longer a continuous, single cut line, but is, rather, two cut lines each extending laterally or sideways from a central or middle integral portion 32B. The action of forming the holder according to this modification is the same, namely, each flap 24 is folded through about 180 degrees so as to assume parallelism with main arcuate strip 12.

While not illustrated, flaps 24 may be located along the lower concave edge 14 of main strip 12, instead of along the upper convex edge 18 as shown, for either the construction of FIG. 1 or that of FIG. 5.

What is claimed is:

1. An annular cup holder for generally conical cups having hot liquids therein, said holder formed from a unitary blank of paperboard, said blank including a main strip of paperboard having a length, said main strip having an upper convex edge and a lower concave edge along its said length, one of said edges having a plurality of flaps integrally secured thereto, said flaps each foldably secured to said main strip, said flaps being spaced from each other along said main strip, each of said flaps having a plurality of holes therethrough, each of said flaps folded over onto the same side of said main strip and into substantial parallelism with said main strip, said blank having opposite ends, said opposite ends secured together to form a ring shaped cup holder.

2. The cup holder of claim 1 wherein each of said flaps is foldably secured to said main strip by an integral hinge, said integral hinge being adjacent an arcuate cut line through said unitary paperboard blank.

3. The holder of claim 2 wherein each said cut of said flaps is curved and collinear with one of said edges.

4. The cup holder of claim 1 wherein each said flap has a base as measured longitudinally along said main strip, and wherein said integral hinge has a width as measured longitudinally along said main strip, said flap base being greater than said integral hinge width.

5. The cup holder of claim 1 wherein there are two said integral hinges securing each said flap to said main strip.

6. A unitary paperboard blank adapted to form a holder for a tapered cup containing hot coffee, said blank including an elongated paperboard strip having a convex upper edge and a concave lower edge, one of said strip edges provided with a plurality of spaced apart flaps, each said flap having a portion integral with said strip, each said flap having a base, each said flap being bendable about said integral portion to a position parallel with said strip, each said flap having a plurality of holes therethrough.

7. The blank of claim 6 wherein there are two said integral portions foldably joining each said flap to said strip.

8. The blank of claim 6 wherein said integral portion for each said flap is located substantially centrally of each said flap, and wherein said cut is in two regions each located laterally of said integral portion.

9. The blank of claim 6 wherein said flaps are located along said convex edge of said strip.

10. The combination of a conical cup for holding a hot drink and an annular paperboard cup holder surrounding and contacting it, said cup holder having a main strip and bent flanges integral with said strip, said bent flanges located between said main strip and said cup and being sandwiched between said main strip and said cup, each of said bent flanges having a plurality of openings to thereby define, with said main strip and said cup, a plurality of closed chambers, whereby said closed chambers function to inhibit the transmission of heat from said hot drink to fingers of a user.

11. The combination of claim 10 wherein each said flap has a base having an integral hinge which joins said flap to said main strip, each said flap base also having a curved cut through said paperboard which facilitates wrinkle free bending of each said flap from said main strip.

12. The combination of claim 10 wherein said flaps have side edges which are spaced from each other and which define, with said cup and said main strip, air channels having ends which are open.

* * * * *